US008104246B2

(12) United States Patent
Nieto et al.

(10) Patent No.: US 8,104,246 B2
(45) Date of Patent: Jan. 31, 2012

(54) METHOD FOR STRENGTHENING A STRUCTURE AND ASSOCIATED ANCHORAGE UNIT

(75) Inventors: Jean-Francois Nieto, Maurepas (FR); Christian Tourneur, Le Mesnil Saint Denis (FR)

(73) Assignee: Freyssinet International (STUP) (FR)

( * ) Notice: Subject to any disclaimer, the term of this patent is extended or adjusted under 35 U.S.C. 154(b) by 1216 days.

(21) Appl. No.: 10/901,321

(22) Filed: Jul. 28, 2004

(65) Prior Publication Data

US 2005/0028477 A1 Feb. 10, 2005

(30) Foreign Application Priority Data

Jul. 28, 2003 (FR) ..... 03 09225

(51) Int. Cl.
*E04B 1/00* (2006.01)
*E04G 21/00* (2006.01)
*E04G 23/00* (2006.01)

(52) U.S. Cl. ..... 52/745.21; 52/223.13

(58) Field of Classification Search ..... 52/223.1, 52/223.13, 223.14, 704, 223.6; 24/69 WT, 24/71 CT, 122.3; 248/231.91; 254/29 A
See application file for complete search history.

(56) References Cited

U.S. PATENT DOCUMENTS 742,332 A * 10/1903 Kunny et al. ..... 188/82.77
1,107,889 A * 8/1914 Burns ..... 403/353
1,686,424 A * 10/1928 Thomson et al. ..... 24/136 R
1,746,879 A * 2/1930 Varney ..... 174/40 R
1,909,332 A * 5/1933 Blackburn ..... 403/275
1,958,747 A * 5/1934 Fiege ..... 174/94 S
2,057,881 A * 10/1936 Creamer ..... 24/122.3
2,163,677 A * 6/1939 Goeller ..... 439/807
2,205,348 A * 6/1940 Del Camp ..... 24/122.3
2,211,615 A * 8/1940 Brickman et al. ..... 24/122.3
2,270,240 A * 1/1942 Freyssinet ..... 52/223.13
2,294,398 A * 9/1942 Ferguson ..... 403/371
2,328,033 A * 8/1943 Schorer ..... 52/223.13
2,371,882 A * 3/1945 Freyssinet ..... 52/223.13
2,449,276 A * 9/1948 Chalos ..... 52/223.13
2,533,064 A * 12/1950 Streader ..... 403/34
2,614,801 A * 10/1952 Mazzei ..... 425/111

(Continued)

FOREIGN PATENT DOCUMENTS

GB 846 346 8/1960

(Continued)

OTHER PUBLICATIONS

Supplementary Partial European Search Report dated Feb. 16, 2004.

(Continued)

*Primary Examiner* — Eileen D Lillis
*Assistant Examiner* — Theodore Adamos
(74) *Attorney, Agent, or Firm* — Banner & Witcoff, Ltd.

(57) ABSTRACT

The invention therefore proposes an anchorage unit for anchoring at least one prestressing member, capable of being tensioned, onto a structural component to be strengthened or repaired by additional prestressing. The anchorage unit includes means of fixing onto the structural component and means of anchoring the prestressing member located adjacent to a first side of the anchorage unit oriented towards a regular section of the prestressing member. The fixing means are located adjacent to a second side, opposite the first side, of the anchorage unit, which is so provided that it may be put into traction when the prestressing member is tensioned.

18 Claims, 3 Drawing Sheets

U.S. PATENT DOCUMENTS 2,668,280 A * 2/1954 Dupre ..... 439/452
3,205,300 A * 9/1965 Becker ..... 174/84 S
3,255,558 A * 6/1966 Middendorf ..... 52/223.13
3,293,811 A * 12/1966 Rice ..... 52/223.13
3,399,434 A * 9/1968 Kelly ..... 403/194
3,462,543 A * 8/1969 Beinhaur et al. ..... 174/94 R
3,524,228 A * 8/1970 Kelly ..... 403/369
3,551,959 A * 1/1971 Mastalski ..... 403/43
3,606,231 A * 9/1971 Kilborn ..... 248/354.3
3,685,934 A * 8/1972 Huber et al. ..... 425/111
3,703,748 A * 11/1972 Kelly ..... 403/368
3,705,376 A * 12/1972 Kinkaid et al. ..... 439/161
3,757,390 A * 9/1973 Edwards ..... 24/115 R
3,762,027 A * 10/1973 Burtelson ..... 29/452
3,795,949 A * 3/1974 Shorter ..... 24/115 R
RE27,954 E * 4/1974 Kelly ..... 403/369
3,801,067 A * 4/1974 Shorter ..... 254/29 A
3,877,113 A * 4/1975 Reyes ..... 24/115 M
3,895,879 A * 7/1975 Burtelson ..... 403/369
3,937,607 A * 2/1976 Rodormer ..... 425/111
3,973,297 A * 8/1976 Bruinette ..... 24/122.6
4,053,974 A * 10/1977 Howlett et al. ..... 29/452
4,203,267 A * 5/1980 Langhorst ..... 52/148
4,304,078 A * 12/1981 Meriwether, Jr. ..... 52/127.2
4,330,970 A * 5/1982 Bonink ..... 52/125.4
4,337,923 A * 7/1982 Smith ..... 254/134.3 FT
4,363,462 A * 12/1982 Wlodkowski et al. ..... 249/190
4,460,420 A * 7/1984 Estrada ..... 156/64
4,510,723 A * 4/1985 Soum ..... 52/223.13
4,616,458 A * 10/1986 Davis et al. ..... 52/223.13
4,678,360 A * 7/1987 Miller ..... 403/353
4,680,906 A * 7/1987 Prevedini ..... 52/223.13
4,700,828 A * 10/1987 Lane, Jr. ..... 206/223
4,724,639 A * 2/1988 Moser ..... 52/223.13
4,812,096 A * 3/1989 Peterson ..... 411/231
4,821,474 A * 4/1989 Rodriguez ..... 52/223.13
4,835,822 A * 6/1989 Savall et al. ..... 24/122.6
5,024,032 A * 6/1991 Rodriguez ..... 52/223.13
5,058,469 A * 10/1991 Rodriguez ..... 83/13
5,079,879 A * 1/1992 Rodriguez ..... 52/223.13
5,168,681 A * 12/1992 Ayrapetyan ..... 52/223.7
5,231,752 A * 8/1993 Hereford ..... 29/461
5,271,199 A * 12/1993 Northern ..... 52/223.13
5,342,568 A * 8/1994 Yokota ..... 264/228
5,440,842 A * 8/1995 Sorkin ..... 52/223.13
5,535,561 A * 7/1996 Schuyler ..... 52/223.13
5,594,977 A * 1/1997 McCallion ..... 24/136 B
5,671,572 A 9/1997 Siller-Franco
5,718,090 A * 2/1998 Wei-Hwang ..... 52/223.14
5,802,788 A * 9/1998 Ozawa et al. ..... 52/223.13
5,839,235 A * 11/1998 Sorkin ..... 52/223.13
5,897,102 A * 4/1999 Sorkin ..... 254/29 A
5,939,003 A * 8/1999 Crigler et al. ..... 264/228
6,145,268 A 11/2000 Korzen
6,195,949 B1 * 3/2001 Schuyler ..... 52/223.13
6,230,448 B1 * 5/2001 Oliver et al. ..... 52/126.7
6,234,709 B1 * 5/2001 Sorkin ..... 403/374.1
6,318,038 B1 * 11/2001 Park ..... 52/223.13
6,354,596 B1 * 3/2002 Rodriguez ..... 277/317
6,393,781 B1 * 5/2002 Sorkin ..... 52/223.13
6,625,945 B2 * 9/2003 Commins ..... 52/293.3
6,748,708 B1 * 6/2004 Fuzier et al. ..... 52/223.13
6,817,148 B1 * 11/2004 Sorkin ..... 52/223.13
7,174,685 B2 * 2/2007 Hayes ..... 52/223.6
2001/0002529 A1 * 6/2001 Commins et al. ..... 52/481.1
2003/0009962 A1 * 1/2003 Hughes ..... 52/223.6

FOREIGN PATENT DOCUMENTS

WO WO 99 57390 11/1999

OTHER PUBLICATIONS

NF p. 95-104, "Repair and Strengthening of Concrete and Masonry Structures" published Dec. 1992 by the French standards association (AFNOR).

* cited by examiner

METHOD FOR STRENGTHENING A STRUCTURE AND ASSOCIATED ANCHORAGE UNIT

BACKGROUND OF THE INVENTION

The present invention concerns strengthening of structures and more specifically strengthening of structures by means of additional prestressing method.

Additional prestressing is a known method for strengthening or repairing concrete or masonry structures and has formed the subject of standard NFP95-104 ("Repair and strengthening of concrete and masonry structures", published in December 1992 by the French standards association (AFNOR)).

It involves generating prestressing forces by putting reinforcing members into tension, for example prestressing cables, external to the structure to be strengthened. The reinforcing members transmit forces to the structure through anchorages bearing on reinforced concrete or metal parts, called bosses, offset from structural components such as existing bracings, beams or walls.

As specified in section 5.2 of standard NF P 95 104, these anchorages are generally fixed by pinning using prestressing bars.

Concrete bosses are large units, which can either be cast in place or precast. However, boss installation proves delicate in either case, especially because of the difficulty in accessing structural components on which bosses must bear. Openings or windows must sometimes be created in the structure to allow bosses to be installed.

Metal bosses are shop fabricated for adaptation to each structure, which ensures their superior fabrication quality compared with concrete bosses. To allow such bosses to have a surface with a sufficiently high friction coefficient bearing on a concrete structural component, this bearing surface must be serrated by machining it or by welding steel wires to it, leading to high construction cost.

According to the method recommended by standard NF 5 P 95-104, reinforcing members pass through the bosses in which they are anchored. Such an anchorage is always made inside the boss on the side opposite to the reinforcing member regular section. It thereby compresses the boss when the reinforcing members are tensioned.

FIG. 1 shows an example of such an anchorage. In the embodiment illustrated in this figure, a boss 1 bears on a bracing 3 of the structure to be strengthened. A prestressing member 2 passes through boss 1 for anchorage therein, at the end opposite the regular section of the prestressing member 2.

Moreover, bosses foreseen by the standard are positioned at the ends of the structure to be strengthened, such that the additional prestress is applied over the longest possible distance. They are therefore often placed near to obstructions, such as structural walls, columns or bracings. This arrangement makes it difficult to place the reinforcing-member tensioning jack.

For this reason, it is generally necessary to displace the boss away from the obstruction to ensure enough clearance to position the jack, which effectively limits prestressing to only a subsidiary part of the structure. Alternatively, the boss may be placed near the obstruction on condition, however, that an opening is made in this obstruction to allow the jack to be positioned. Applying the resulting prestress is better than in the former case, but this solution requires concrete break-out or drilling work to be performed.

one object of the present invention is to overcome the drawbacks of the current methods recalled above by allowing prestress to be applied to a major section of the structural component to be strengthened, whilst avoiding implementation of work involving breaking out part of the structure for strengthening purposes.

Another object of the invention is to have an anchorage well suited to the structure to be strengthened, without requiring additional adaptation operations such as machining of an anchorage block surface bearing on a member of the structure to be strengthened.

SUMMARY OF THE INVENTION

The invention therefore proposes an anchorage unit for anchoring at least one prestressing member, capable of being tensioned, onto a structural component to be strengthened or repaired by additional prestressing, including means of fixing or attaching onto the said structural component and means of anchoring the prestressing member located adjacent to a first side of the anchorage unit oriented towards a regular section of the prestressing member. According to the invention, the fixing means are located adjacent to a second side, opposite the first side, of the anchorage unit, which is so provided that it may be put into traction when the prestressing member is tensioned.

When part of the structure, whose ends are not easily accessible, must be strengthened by additional prestressing, this anchorage unit enables the required compressive stress to be applied to the whole of the considered area. Because the anchorage unit works essentially in tension between the anchoring means adjacent to the adjacent to the first side and the fixing means adjacent to the opposing, second side, compressive stress is applied to the structure right up to the fixing means, in other words almost as far as the second side of the anchorage unit. This second side may be located near to an obstruction that would hamper implementation of conventional anchorages.

Moreover, the invention proposes a method for strengthening or repairing a structure by additional prestressing comprising implementation of such an anchorage unit. This method includes the following steps:

- fixing onto a structural component of the structure at least one anchorage unit comprising a section capable of anchoring at least one end of a prestressing member fixed at its other end to the structure, the said part of the anchorage unit being adjacent to a first side, oriented towards the regular section of the prestressing member, the structural component fixing being adjacent to a second side, opposite the first side, of the anchorage unit;
- tensioning the prestressing member, and
- anchoring the prestressing member inside the said section of the anchorage unit, such that the anchorage unit is put into traction.

DESCRIPTION OF PREFERRED EMBODIMENTS

Figures 2, 3:
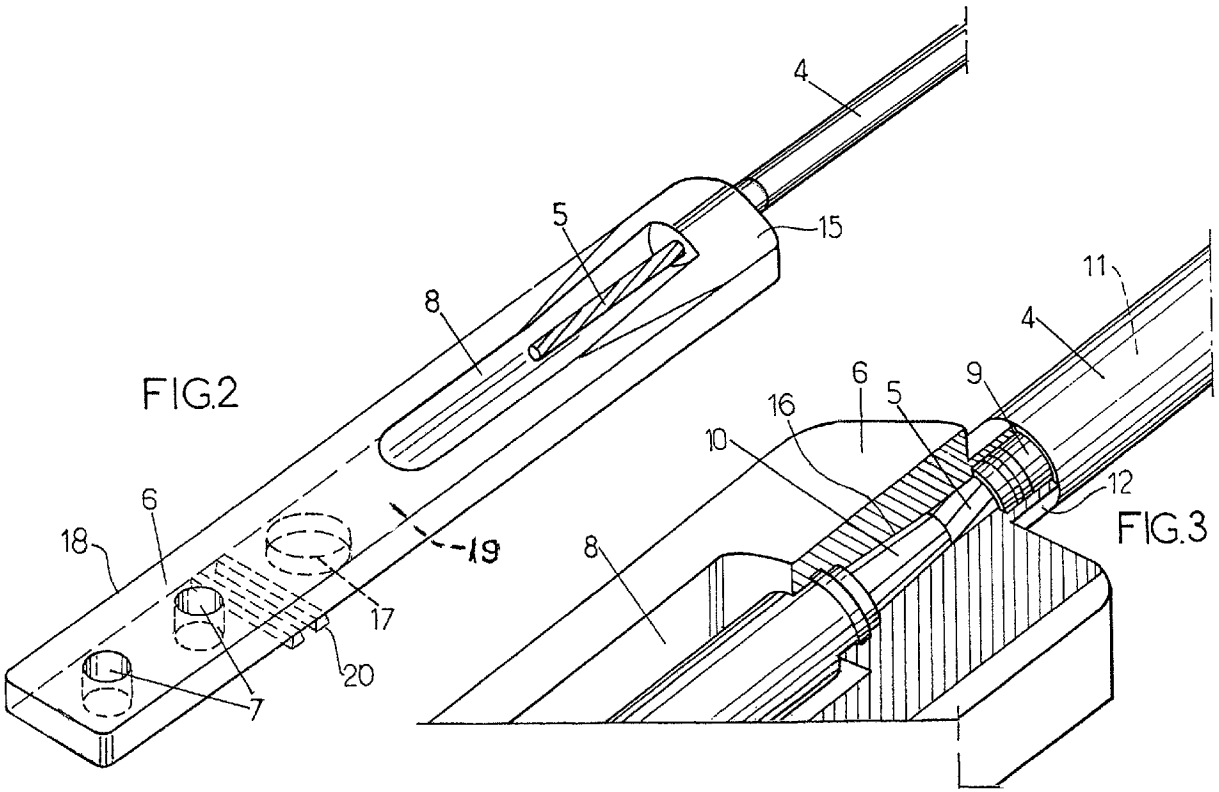
FIG. 2 is a simplified diagram of an anchorage unit according to the invention.
FIG. 3 is a sectional view of a portion of the anchorage unit shown in FIG. 2 and of the anchorage formed in this portion.

FIG. 2 represents an anchorage unit 6 according to the invention. This unit is capable of anchoring a reinforcing member also designated by prestressing member or a set of reinforcing members to strengthen a structural component by additional prestressing.

Reinforcing members used for prestressing are conventionally metallic. In particular, they may feature strands 5 capable of being tensioned and forming a cable in their regular section, in other words between anchorage zones. Strands are generally protected from corrosion in their regular section, 11 for example by a high-density polyethylene (HDPE) sheath 4 enclosing the strands 5 and injected with cement grout or a non-adhesive soft material 12 such as grease or wax.

The anchorage unit 6 is integral and compact. It is favourably made of cast iron. At one of its ends (15 on the right in FIG. 2), it features an orifice or passage 16 allowing reception of at least one strand 5 of the cable, whose sheath terminates at the anchorage unit input. A recess or housing 8 is provided in the anchorage unit 6 to receive the end of the strand 5. It is open on one face of the anchorage unit 6, such that the anchored end of the strand 5 is accessible from outside the anchorage unit 6.

FIG. 3 shows more specifically an example of an anchorage formed within anchorage unit 6. The strand 5 penetrates into the anchorage body member or unit 6. The end 15 of the anchorage unit receiving the strands has an orifice 16 capable of accommodating an anchoring jaw 10. The orifice 16 may, for example, be frustoconical, in which case the jaw 10 wedges itself in the orifice by conical wedging. Once the strand 5 is tensioned to generate prestress, it will then be firmly clamped by the jaw 10 thereby effecting a means for anchoring.

Furthermore, in an advantageous embodiment, the cast iron anchorage unit 6 may be cast to feature orifices that permit sealing of prestressing cable sheath 4 connections with the anchorage unit 6. A connection collar 9 and seals may then be inserted into these anchorage unit 6 entry orifices to ensure such a seal.

Figure 4:
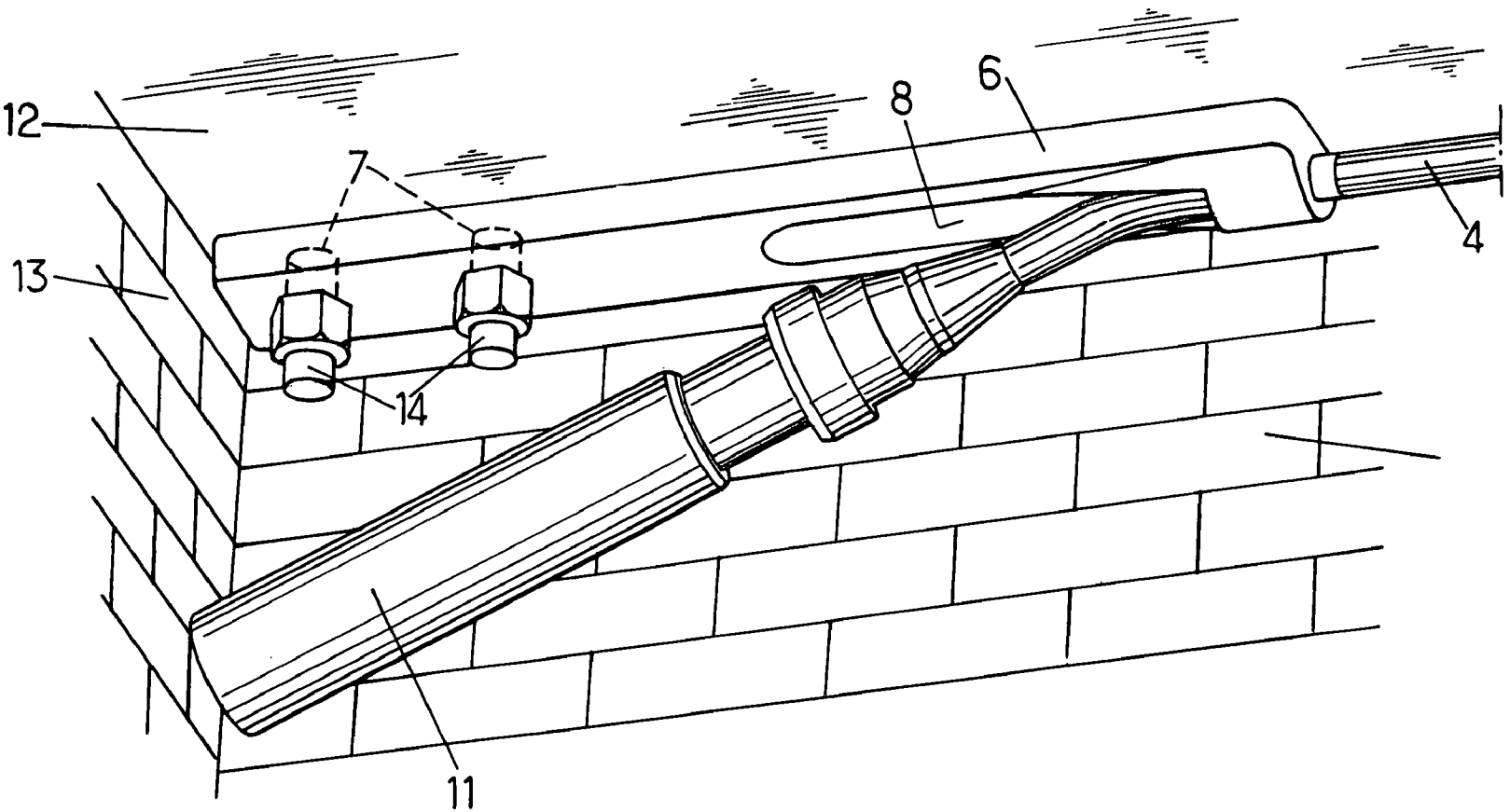
FIG. 4 represents a method of strengthening a structural component according to the invention.

Moreover, the anchorage unit 6 has means of fixing onto the structural component to be strengthened or repaired, which may be an industrial building floor, for example. FIG. 4 shows an example of fixing the anchorage unit 6 onto a floor slab 12. The anchorage unit 6 may be fixed, for example, by pinning one or more prestressing bars 14 into the floor slab 12. In this case, orifices 7 may be provided in the anchorage unit 6 to allow prestressing bars 14 to be introduced.

According to the invention, the anchorage unit 6 section 18 opposite the strand 5 anchorage 15, in other words the anchorage unit 6 section 18 furthest away from the prestressing cable regular section, is fabricated such that it may be fixed onto the structural component to be strengthened. In FIGS. 2 and 4, therefore, the orifices 7 capable of receiving the prestressing bars 14 are located in the left-hand section of the anchorage unit 6 to provide a means for fixing.

Figure 1:
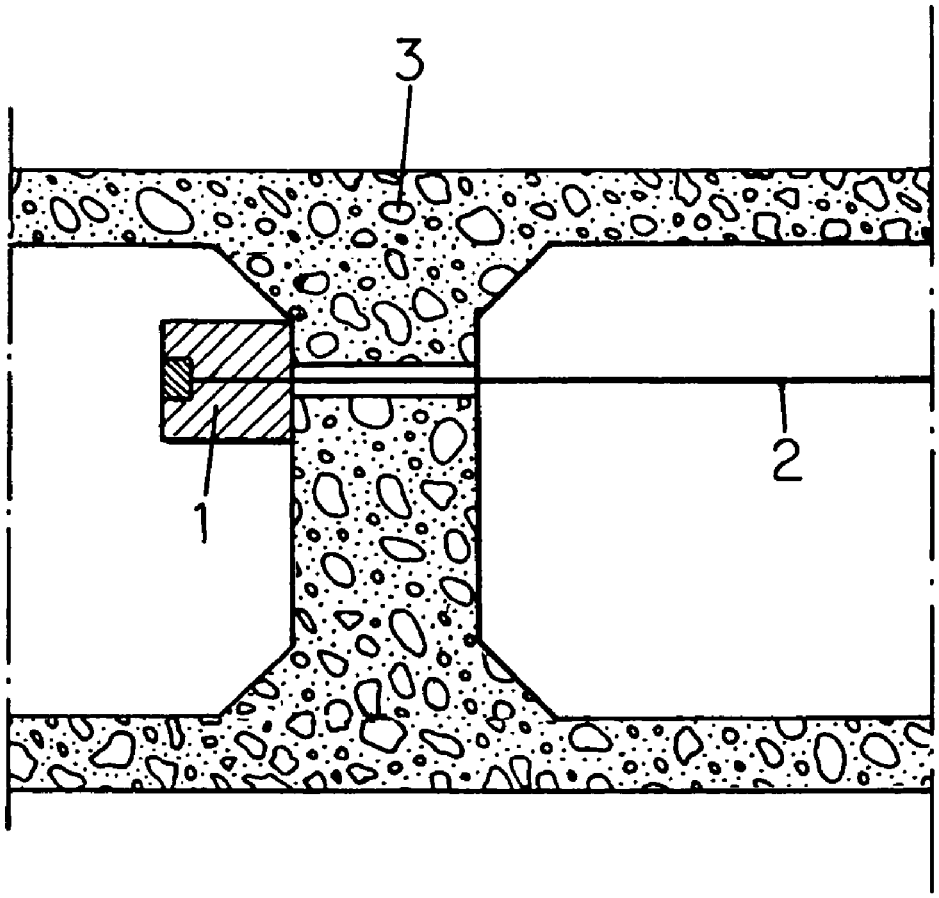
FIG. 1, already commented upon, is a diagrammatic sectional view of a device for strengthening a structure by additional prestressing, as specified in AFNOR standard NF P 95-104.

As represented in FIG. 4, the anchorage unit 6 is therefore understood to be put into traction when the strand 5 is tensioned. The strand 5 exerts effectively a tensile force on the right-hand section 15 of the anchorage unit 6 in the direction of the cable regular section, whilst anchorage unit 6 is fixed to floor slab 12 by pinning performed through its left-hand section 18. This type of anchorage therefore differs from conventional bosses 1, such as those shown in FIG. 1, which are compressed against a structural component as a result of the force exerted by the tensioned prestressing cable 2.

The combination so formed therefore allows the resultant of the pinning and tensioning forces to be transmitted to the structure to be strengthened.

In an advantageous embodiment, the anchorage unit 6 fixed to the concrete floor slab 12 has a bearing surface 19 featuring cast serrations 20 in contact with the structural component 12. Such casting of the iron enables effective bonding of the anchorage unit 6 with the concrete to be obtained without having to perform expensive additional operations, for example machining of the anchorage unit 6.

The arrangement foreseen by the invention is particularly advantageous because it allows the strand 5 to be tensioned without having to displace the anchorage away from the wall or obstruction 13, which backs onto the anchorage unit 6. The end of the strand 5 is effectively accessible at the housing 8 of the anchorage unit 6. The housing 8 is located at the distance from the anchorage unit fixing zone (illustrated by the orifices 7). A tensioning jack fitted with a curved tip can easily be installed in the available space beneath the anchorage unit 6. Resorting to breaking out or drilling the wall 13 to tension the strand 5 may therefore be avoided, unlike the common practice with conventional bosses.

Moreover, such an arrangement permits sufficient excess length of cable for retensioning or, on the contrary, relaxing the strand 5 after initial tensioning and trimming of the strand 5.

A protective cap or sleeve 11 can be advantageously installed to protect the end of the strand 5 after it leaves the housing 8, as illustrated in FIG. 4.

When prestressing forces to be applied are very high, the prestressing bars "pinning" the anchorage units onto the structure may not be enough to anchor all the cable force exerted on the structure by friction because the friction coefficient of serrated cast iron on concrete (of the order of 0.6) requires a very high pinning force. In this case, it may be advantageous to transfer all forces between the anchorage unit and the structure by combining friction and direct bearing. Direct bearing is obtained, for example, by means of a recess 17 provided in the form of a blind hole in the anchorage unit face intended to be applied against the structure (FIG. 2). During construction, a bearing stud of complementary shape to that of the recess 17 is fixed to the structure. To ensure a satisfactory distribution of forces between friction and direct bearing, there should be no play at this stud. This is ensured by injecting a sealant into the recess 17 when the anchorage unit 6 is installed. This sealant is a resin paste or a grout, for example.

While a preferred embodiment has been disclosed, the invention is to be limited only by the following claims and equivalents. The embodiments disclosed are examples of the invention and the invention is not limited to the specific embodiments.

The invention claimed is:

1. A method for strengthening or repairing a structure by prestressing, including the following steps:

fixing onto a structural component of the structure at least one unitary anchorage unit, said unit including a prestressing member anchorage end section, an anchorage unit section opposite the prestressing member anchorage end section, and a bearing surface extending longitudinally between the prestressing member anchorage end section and the anchorage unit section, said prestressing member anchorage end section including means for anchoring a first end of at least one prestressing member that may be tensioned along a substantial part of the structural component to be strengthened or repaired by additional prestressing wherein said anchorage unit section is fixed to a surface of said structural component, said bearing surface of the anchorage unit extending longitudinally substantially in the same direction as the prestressing member, wherein said anchorage unit is so oriented and provided that it is put mainly into longitudinal traction when the prestressing member is tensioned along said substantial part of the structural component and maintains said bearing surface on the structural component surface, whereby the anchorage unit does not pass through the structural component, said anchorage unit further comprising an opposite side spaced from the bearing surface, said opposite side of the anchorage end section including a generally longitudinal recess spaced from and terminating before the anchorage unit section with an orifice at one end thereof to a generally longitudinal passage extending to an input opening for said prestressing member at the end of the prestressing anchorage end section, said passage for substantially totally surrounding the prestressing member extending generally longitudinally from the recess through the orifice and input opening;

performing prestressing of said substantial part of the structural component by tensioning the prestressing member along said substantial part of the structural component by means of tensioning means external to the anchorage unit, the prestressing member being external to the structural component and having a second end fixed to said structure, and anchoring the prestressing member at the prestressing member anchorage end section of said anchorage unit such that the anchorage unit is put into longitudinal traction.

2. A method for strengthening or repairing a structure by prestressing, including the following steps:

fixing onto a structural component of the structure at least one unitary anchorage unit, said unit including a prestressing member anchorage end section, an anchorage unit section opposite the prestressing member anchorage end section, and a bearing surface extending longitudinally between the prestressing member anchorage end section and the anchorage unit section, said prestressing member anchorage end section including means for anchoring a first end of at least one prestressing member that may be tensioned along a substantial part of the structural component to be strengthened or repaired by additional prestressing wherein said anchorage unit section is fixed to a surface of said structural component, said bearing surface of the anchorage unit extending longitudinally substantially in the same direction as the prestressing member, wherein said anchorage unit is so oriented and provided that it is put mainly into longitudinal traction when the prestressing member is tensioned along said substantial part of the structural component and maintains said bearing surface on the structural component surface, whereby the anchorage unit does not pass through the structural component, said anchorage unit further comprising an opposite side spaced from the bearing surface, said opposite side of the anchorage end section including a generally longitudinal recess spaced from and terminating before the anchorage unit section with an orifice at one end thereof connected to a generally longitudinal passage extending to an input opening for said prestressing member at the end of the prestressing anchorage end section, said passage for substantially totally surrounding the prestressing member extending generally longitudinally from the recess through the orifice and input opening; the thickness of said anchorage unit between the bearing surface and opposite side being greater at the prestressing member anchorage end, performing prestressing of said substantial part of the structural component by tensioning the prestressing member along said substantial part of the structural component by means of tensioning means external to the anchorage unit, the prestressing member being external to the structural component; and anchoring the prestressing member at the prestressing member anchorage end section of said anchorage unit by clamping said prestressing member with a jaw device such that the anchorage unit is put into longitudinal traction.

3. The method according to claim 1 or 2, wherein the thickness of the anchorage unit between the bearing surface and opposite side is greater at the prestressing member anchorage end section.

4. The method of claim 1 or 2, wherein the anchorage unit is cast as a unitary unit.

5. The method according to claim 1 or 2, in which the anchorage unit is made of cast iron.

6. The method according to claim 1 or 2, in which fixing of the anchorage unit onto the structural component includes pinning using at least one prestressing bar.

7. The method according to claim 1 or 2, in which fixing of the anchorage unit onto the structural component includes introducing fixing means in said orifice of the anchorage unit.

8. The method according to claim 1 or 2, in which fixing of the anchorage unit onto the structural component includes applying the anchorage unit bearing face featuring cast serrations against the structural component.

9. The method according to claim 1 or 2, in which the structural component includes an obstruction, located opposite a regular section of the prestressing member, and in which fixing of the anchorage unit onto the structural component is performed such that the anchorage unit is positioned substantially near said obstruction.

10. The method according to claim 1 or 2, in which the prestressing member comprises a prestressing cable enclosed by a sheath in a regular section of the cable and in which prestressing member anchorage includes introducing the end of the prestressing member into said orifice in said anchorage unit, capable of ensuring anchorage, in such a way as to allow a sealed connection between the anchorage unit and the cable sheath.

11. The method according to claim 1 or 2, in which a bearing stud is moreover fixed to the structural component to operate in combination with a recess provided on the anchorage unit, and in which a sealant is injected into the recess when the anchorage unit must be placed on the structural component.

12. The method according to claim 1 or 2 wherein said tensioning means comprises a jack device.

13. The method of claim 1 or 2 wherein said structure comprises a prestressed structure.

14. The method of claim 1 or 2 wherein said prestressing member is tensioned along said substantial part of the structural component without passing through said structural component.

15. The method of claim 1 or 2 further including positioning a fixing means in the passage to retain the prestressing member.

16. The method of claim 1 or 2 including providing said passage with a frustoconical section located at the orifice for receipt of a wedge device.

17. The method of claim 1 or 2 wherein said prestressing member comprises a cable.

18. The method of claim 1 or 2 wherein anchoring the prestressing member comprises clamping said prestressing member with a jaw device.

* * * * *